US006945450B2

(12) United States Patent
Rusnock

(10) Patent No.: US 6,945,450 B2
(45) Date of Patent: Sep. 20, 2005

(54) BEVERAGE COOLER CARTON

(75) Inventor: Kevin R. Rusnock, Broomfield, CO (US)

(73) Assignee: Coors Global Properties, Inc., Lakewood, CO (US)

( * ) Notice: Subject to any disclaimer, the term of this patent is extended or adjusted under 35 U.S.C. 154(b) by 247 days.

(21) Appl. No.: 10/229,811

(22) Filed: Aug. 27, 2002

(65) Prior Publication Data

US 2004/0040334 A1 Mar. 4, 2004

(51) Int. Cl.[7] ..... B65D 65/00

(52) U.S. Cl. ..... 229/243; 62/457.5; 229/101; 229/119

(58) Field of Search ..... 229/101, 119, 229/240, 242, 243; 206/427; 62/457.1, 457.4, 457.5, 457.7

(56) References Cited

U.S. PATENT DOCUMENTS

| | | | | | |
|---|---|---|---|---|---|
| 415,980 | A | | 11/1889 | Sachs | |
| 975,792 | A | | 11/1910 | Pittman | |
| 2,791,367 | A | | 5/1957 | Mefford | |
| 2,810,506 | A | | 10/1957 | Kessler | |
| 2,844,299 | A | | 7/1958 | Kessler et al. | |
| 2,979,227 | A | | 4/1961 | Norton et al | 220/105 |
| 3,006,165 | A | | 10/1961 | Mittelberger | 62/371 |
| 3,031,121 | A | | 4/1962 | Chase | 220/915.1 |
| 3,119,494 | A | | 1/1964 | Rosenstiel | 206/46 |
| 3,206,104 | A | * | 9/1965 | Cohen | 229/117.23 |
| 3,355,089 | A | * | 11/1967 | Champlin | 229/243 |
| 3,533,549 | A | * | 10/1970 | Gilchrist | 229/242 |
| 3,974,658 | A | | 8/1976 | Starrett | 220/592.02 X |
| D242,901 | S | | 1/1977 | Lohrbach | D9/224 |
| 4,139,146 | A | | 2/1979 | Bamburg et al. | |
| D259,615 | S | | 6/1981 | Morris, Jr. | D7/605 |
| 4,328,923 | A | | 5/1982 | Graser | |
| 4,382,511 | A | * | 5/1983 | Hamelin et al. | 206/427 |
| 4,386,700 | A | | 6/1983 | Deaton | 206/507 |
| D271,944 | S | | 12/1983 | Wood | D9/416 |
| 4,530,459 | A | | 7/1985 | Maroszek | 229/117.12 X |
| D281,120 | S | | 10/1985 | Rabinowitz | D3/243 |
| 4,676,429 | A | | 6/1987 | Crowe et al. | 229/109 |
| 4,706,805 | A | | 11/1987 | Becher | 206/144 |
| 4,709,852 | A | | 12/1987 | Stoll | 229/119 |
| D297,214 | S | | 8/1988 | Forbes, Jr. | D9/416 |
| 4,765,476 | A | | 8/1988 | Lee | 206/427 |
| 4,777,992 | A | | 10/1988 | Olger | 150/52 R |
| 4,858,444 | A | | 8/1989 | Scott | 62/372 |
| 4,869,387 | A | | 9/1989 | Persson | 220/20.5 |
| 4,899,553 | A | | 2/1990 | Drummond, III | 62/372 |
| 4,948,033 | A | | 8/1990 | Halsell, II et al. | |
| D311,493 | S | | 10/1990 | Boone | D9/416 |
| 4,974,731 | A | * | 12/1990 | Wood | 229/117.13 |
| 5,020,337 | A | | 6/1991 | Krieg | 62/464 |
| 5,072,876 | A | | 12/1991 | Wilson | 206/427 |
| 5,094,359 | A | | 3/1992 | DeMars et al. | 220/462 |
| 5,101,642 | A | | 4/1992 | Alexandrov | 62/371 |
| 5,170,934 | A | * | 12/1992 | Lemoine | 229/101 |
| D334,255 | S | | 3/1993 | Nelson | D30/162 |
| 5,246,112 | A | | 9/1993 | Stout et al. | 206/427 |
| 5,284,294 | A | | 2/1994 | Floyd | 229/179 |
| 5,303,863 | A | | 4/1994 | Arasim | 229/227 |
| 5,307,986 | A | * | 5/1994 | Schuster | 229/101 |
| 5,495,727 | A | | 3/1996 | Strong et al. | 62/529 |
| 5,582,343 | A | | 12/1996 | Dalvey | 206/427 |
| 5,704,470 | A | | 1/1998 | Sutherland | 206/427 |
| D446,448 | S | | 8/2001 | Jernigan et al. | D9/418 |
| D452,154 | S | | 12/2001 | Rhodes et al. | D9/432 |
| 6,631,803 | B2 | | 10/2003 | Rhodes et al. | 206/427 |

* cited by examiner

*Primary Examiner*—Gary E. Elkins
(74) *Attorney, Agent, or Firm*—Sheridan Ross P.C.

(57) ABSTRACT

A beverage cooler carton is provided which is intended to receive ice or other cooling means to keep contents packaged therein cool. The carton is made of a material which is impervious to liquid which may be contained within the carton during use. The carton includes folding end panels which extend continuously between adjacent upper and lower panels; therefore, there are no seams or breaks in the material around a periphery of the carton which might degrade the ability of the carton to hold a liquid. Also disclosed is a method of assembling the cooler carton.

15 Claims, 3 Drawing Sheets

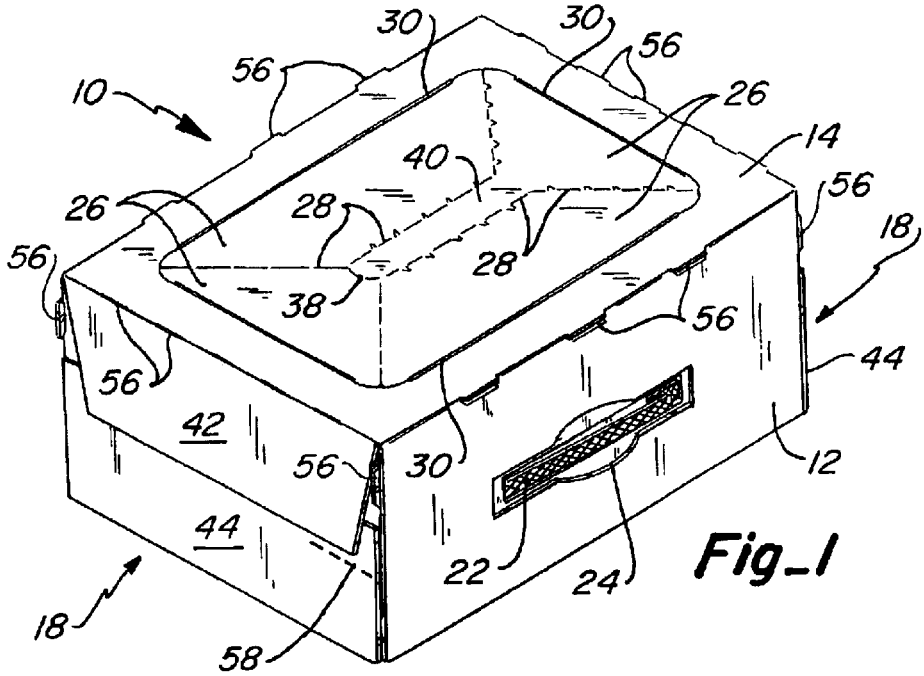
Fig_1
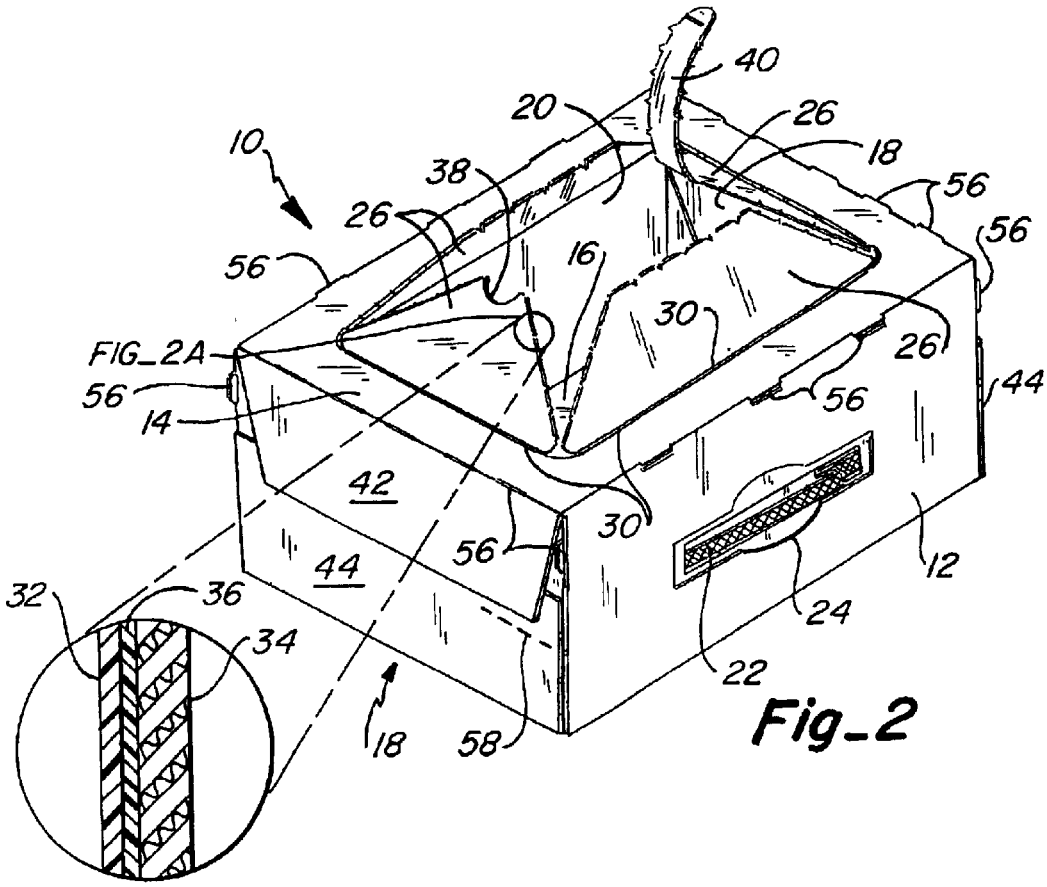
Fig_2
Fig_2A

BEVERAGE COOLER CARTON

FIELD OF THE INVENTION

The present invention relates to cartons or packages, and more particularly, to a carton or package for a plurality of canned or bottled beverages, wherein the carton is adapted for receiving ice or other cooling means to keep the beverages chilled.

BACKGROUND OF THE INVENTION

Typically, beverages such as soda or beer are packaged in groups of six, twelve or twenty-four containers. If no refrigeration source is available, the beverages have to be consumed at the environmental temperature in which they are stored. The most common means for chilling such beverages is to place them in portable coolers, or to place them within refrigeration units.

A number of prior art devices exist which are intended to provide a package which is able to accept ice or other cooling means in order to chill beverages in the package without having to use a separate cooling source. Thus, the beverages can be directly chilled without having to use a refrigeration unit or a portable cooler.

One example of a reference disclosing an expandable package to accommodate ice includes the U.S. Pat. No. 5,495,727. The package further includes drain holes which allow for drainage of any fluids which condense on the beverages or which leak from the beverages during shipment and handling. The package is lined with a waterproof or water resistant material to provide a means to prevent or substantially reduce leakage of liquids from within the package.

U.S. Pat. No. 4,329,923 discloses a cooler container for packaging a plurality of multiple articles such as cans or bottles. The container has a top portion designed to receive a quantity of bulk ice which may be placed in contact with the multiple articles. In operation, side and end flaps are pulled up and form an upper waterproof well area which retains the bulk ice. The well area is situated on top of the multiple articles which are packaged in a lower waterproof compartment.

U.S. Pat. No. 5,020,337 discloses a combination ice package and expandable cooler. This reference shows a box-type receptacle with an extendable upper portion consisting of folded cardboard flaps. The upper portion further includes expandable top flaps which fold to form a top seal through the use of frictional engagement offset notches. Circular access layers are formed in the upper portion enabling drinks to be inserted and recooled while being consumed.

U.S. Pat. No. 5,094,359 discloses a combination packaging/shipping carton and ice bucket. This carton expands to be used as an ice bucket, in addition to its primary function of being a packaging carton for containers. The carton includes triangular webs which move from an abutting position to an inline position during forming of the carton to be used as the ice bucket. Side and end panels of the carton have foldable flaps which enclose the carton chamber to the environment. When the foldable flaps are moved away from each other to assume an inline position, the container is open to the environment, thus increasing the size of the container to permit usage of the carton as an ice bucket.

U.S. Pat. No. 5,303,863 discloses a beverage carton with an integral cooler bin. The carton includes a plurality of panels in a stacked relationship which, when unfolded, form an ice bin which is connectable to the top portion of the compartment of the carton. Ice is poured into the bin formed by the unfolded panels, and cans are cooled by direct contact with the ice.

While the foregoing inventions may be adequate for their intended purposes, each have certain disadvantages which are common to the prior art in general. One prominent disadvantage in many of the prior art inventions is that the cartons or packages are structurally complex, and are, therefore, expensive to manufacture. Additionally, although many prior art devices are structurally complex, they are not configured in a reinforced manner to hold ice or water for long periods of time. Another disadvantage of prior art devices is that cooled water from melted ice is allowed to drain away from the package, which minimizes the cooling effect of melted ice. Each of these disadvantages are overcome with the carton of this invention.

SUMMARY OF THE INVENTION

The beverage cooler carton of the invention provides for the packaging of individual beverages, and allows ice or other cooling means to be added directly to the carton to cool or chill the beverages. In its simplest form, the cooler carton may be made from a single sheet of composite material which is cut to a desired shape, and then folded along fold lines and score lines to an assembled shape. The cooler carton is a six-sided structure having spaced and substantially parallel lower and upper panels, front and rear panels, and opposing end panels which abut the front and rear panels in perpendicular arrangement. When assembled, the cooler carton defines an open interior space which may hold various types of beverages or other products that are to be marketed to a consumer. A liquid containment area is defined within the cooler carton by lower portions of the end panels, front and rear panels, and the lower panel.

The end panels incorporate a folding combination of flaps which provide considerable strength to the construction of the carton, and ensure the integrity of the liquid containment area. Each end panel has a upper flap, lower flap, and a pair of side flaps which are folded back upon one another thereby forming a continuous and unbroken series of panel pieces which thereby form the liquid containment area that may hold a volume of liquid without leaking. A diagonal fold separates each side flap into an upper side flap and a corresponding lower side flap. A notch or recess may be cut out of the upper side flap thereby facilitating folding of the lower side flap against the upper side flap when the lower flap is folded towards the carton.

Perforations or spaced score lines are formed on either the front or rear panel of the carton thereby allowing access to the interior of the carton. In the preferred embodiment, the perforations/score lines define a tab which when pulled forms an access opening, and adjacent perforations/score lines define a plurality of access panels which may be folded outwardly thereby increasing the size of the access opening. To facilitate folding of the access panels, fold lines may also be incorporated on each access panel at the junction of the access panel and the front or rear panel on which the access panels are formed.

The carton is constructed of a material which has not only advantageous strength characteristics, but is also substantially water-resistant to allow melted ice or other cooling liquid to remain within the carton, and thus able to continue to cool the contents of the carton. Of course, if the liquid is desired to be removed, it may be simply poured out from the access opening.

Preferably, the carton is constructed of a multiple-layered material, including a substrate such as kraft board, and a polyethylene film or membrane which is applied to the substrate by a heated polyethylene extrudate. Alternatively, the polyethylene film or membrane could be applied as by an adhesive. The extrudate or adhesive may be first applied upon the substrate, and then the polyethylene film may be applied to the substrate coated with the extrudate/adhesive wherein the extrudate/adhesive bonds the substrate to the polyethylene film. If the extrudate is used, the extrudate is molten when applied and may be extruded through a die which results in formation of a liquid curtain of extrudate applied to the substrate. Depending upon the strength and stiffness required for the carton, various grades of paperboard can be used such as posterboard, card stock, or chip board. In addition to polyethylene as the film or membrane, other materials can be used to include polyester, polypropylene, or any other material that can be applied to the substrate in a very thin, even coat, and that is liquid impermeable. When the carton is assembled, the polyethylene film is on the outside or exposed surfaces of the box. Accordingly, liquid contained within the container is able to seep into the substrate, but is prevented from leaking from the carton by both the extrudate or adhesive and the polyethylene film. Therefore, there are essentially two layers of liquid-impervious materials which are used to prevent liquid from escaping the interior of the carton. Conveniently, the polyethylene film is also an ideal material which may accept printing or labeling. Printed material may be directly applied to the polyethylene film. The film can accept printing by reverse or surface printing methods.

Although the carton of the present invention is shown as a six-sided configuration, it shall be understood that the present invention can be modified to conform to the particular shape of the contents to be packaged. Additionally, it shall be understood that access to the contents of the carton can be achieved by forming access panels on any major panel that is large enough to facilitate removal of the beverages stored therein.

Finally, although the present invention has particular utility with reference to cooling of beverages, the present invention is equally suitable for cooling any other type of canned, bottled, or jarred foods.

BRIEF DESCRIPTION OF THE DRAWINGS

FIG. 1 is a perspective view of the beverage cooler carton of this invention;

FIG. 2 is another perspective view of the cooler carton of this invention showing the panel perforations broken for access to the carton contents;

FIG. 2A is a greatly enlarged cross section of the designated area on FIG. 2 showing the composite or multilayered material which may be used;

DETAILED DESCRIPTION OF THE DRAWINGS

Figure 3:
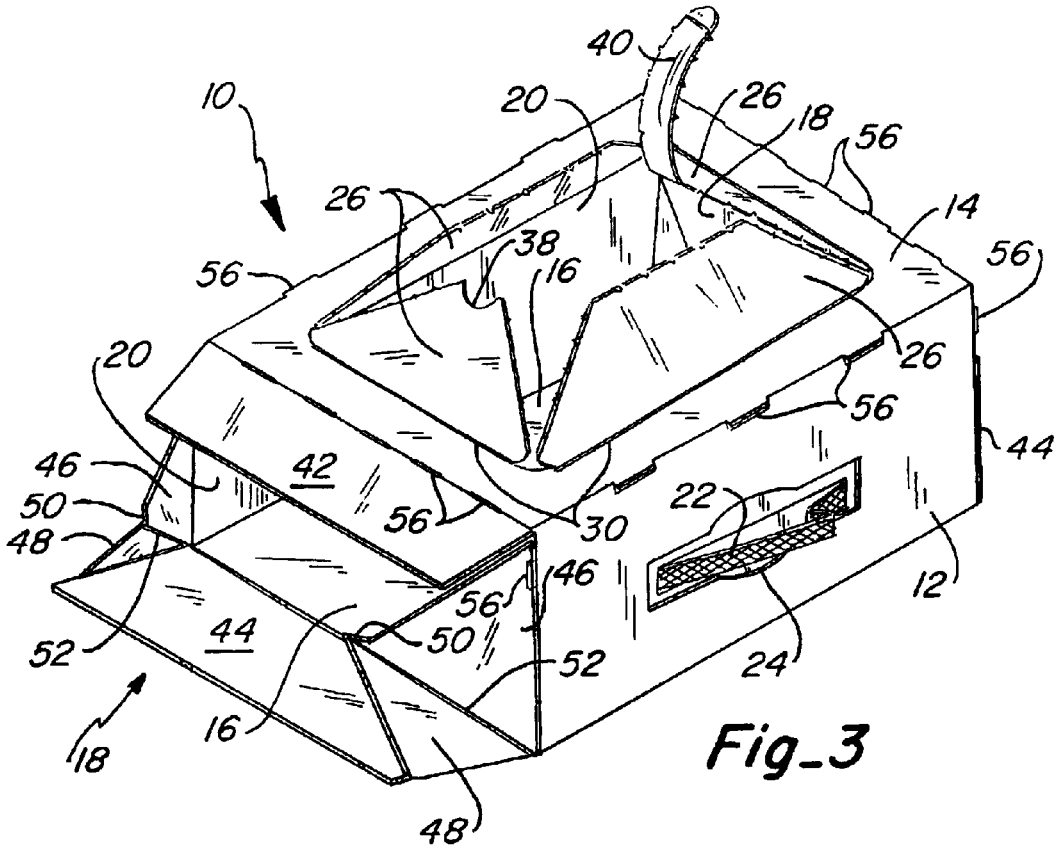
FIG. 3 is another perspective view of the carton of this invention partially assembled, namely, one end panel of the carton is open showing the various component flaps which form an end panel.

FIGS. 1 and 2 are perspective views of the carton 10 according to a preferred embodiment of the present invention. In the perspective view of FIG. 1, the carton 10 is assembled, and has yet to be opened by a consumer. The carton is defined by a plurality of panels including an upper panel 12, front panel 14, rear panel 16, end or side panels 18, and a lower panel 20. A handle 22 may be connected to the upper panel 12. The handle 22 includes a base 24 which may be made of a material which is somewhat thicker and stiffer than the construction of the carton panels. The base 24 can be glued to the underside of the upper panel 12, and an opening may be cut in the upper panel 12 thereby allowing the handle 22 to be exposed for grasping by the consumer.

As shown in FIGS. 1 and 2, the carton of the present invention is placed upon its side that allows the front panel 14 to be facing upwards. In this configuration, the interior contents of the carton may be accessed by breaking the access panel perforations 28 which define the respective access panels 26. As seen best in FIG. 2, the preferred manner in which the carton is opened to access the contents within the carton is to activate the tab 40 by placing a finger to depress the finger perforation 38 and then pulling back on the tab 40. By pulling on the tab, the perforations are broken around the tab, and the only remaining perforations to break are the perforations 28 which intersect with the finger perforation 38. These perforations are easily broken by simply pulling up on the access panel 26 which lies adjacent the end panel 18. As desired, the access panels may then be folded about their respective fold lines 30 in order to increase the size of the access opening. When it is desired to cool the beverages within the carton, ice may be placed within the access opening directly on the beverage containers. The size of the access opening is large enough so that a mound or pile of ice which is placed within the access opening can contact most or all of the upper surfaces of the beverages within the carton. The access panels 26 act as supports to hold the mound or pile of ice which may be stacked at a height which could even be above the upper ends of the access panels, and as the ice melts, the access panels will naturally fold back towards their original position as there will continue to be some tension in the fold lines 30 which normally urge the access panels 26 back to their original unfolded positions.

Figure 4:
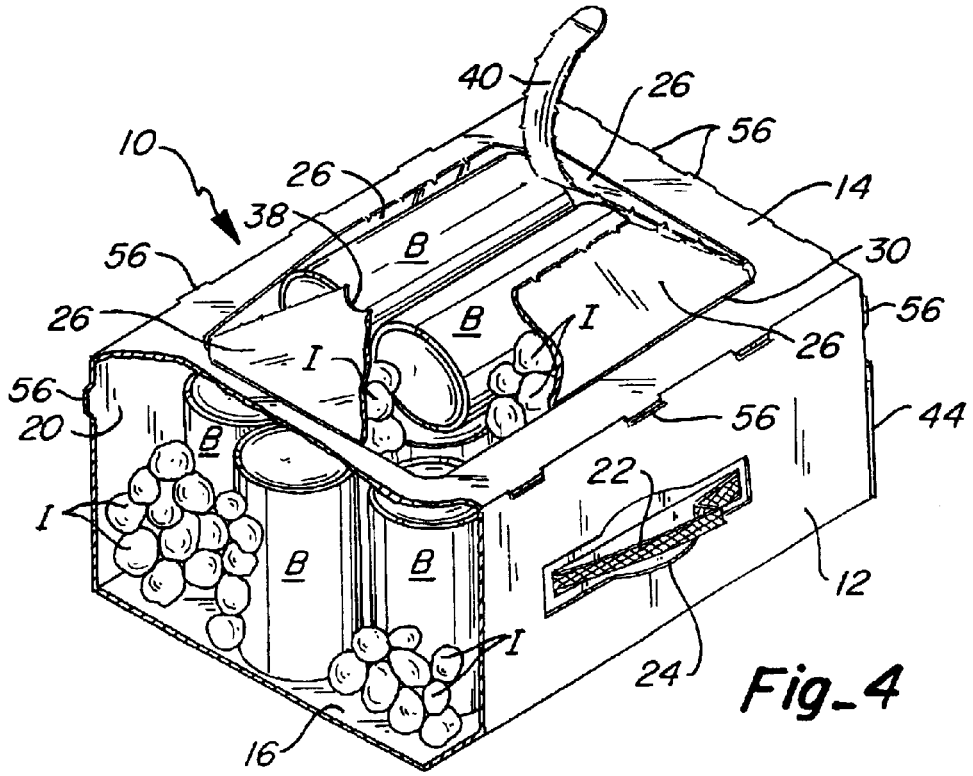
FIG. 4 is a fragmentary perspective view showing the carton housing a plurality of canned beverages and ice.

Referring now specifically to FIG. 4, another method by which a consumer may cool the beverages within the carton is to actually remove one or two of the beverages, and then add ice I within the carton so that the ice I resides around the side edges and/or upper surfaces of the beverages B. The removed beverages B can then be placed within the access opening. The access panels 26 again act as supports which may hold the beverages B, and can further accommodate some additional amount of ice I which is placed around the removed beverages within the space created by the upward folded access panels 26.

Although the Figures illustrate the use of canned beverages, it shall be understood that any other type of beverage or food containers may be used with the carton of this invention. Additionally, other cooling means could be used to cool the contents of the carton, such as a frozen slush mixture of ice and water, or conventional ice packs of the type that are re-frozen after use.

FIG. 2A illustrates the composite or multilayered structure of the material which may be used for the carton of this invention. The cross section shown is not necessarily to scale, and is simply provided to show the multilayered nature of the material. Specifically, the polyethylene film 32 is shown as the exterior layer, which is secured to the substrate 34 by the thin layer 36 of polyethylene extrudate.

FIG. 3 illustrates one end panel 18 opened in order to demonstrate the manner in which the various flaps are folded to secure the end panel against the carton. As shown, the opened end panel 18 includes a plurality of flaps, namely, an upper flap 42, a lower flap 44,and a pair of side flaps which interconnect opposite sides of the lower flap 44.

Each of the side flaps include a lower side flap 48 having an edge which connects to one end of the lower flap 44, and each side flap further includes an upper side flap 46 having an edge which connects to the adjacent upper or lower panel 12/20. A diagonal fold or score 52 interconnects the upper side flap 46 to the lower side flap 48, and the lower side flap 48 is foldable against the upper side flap 46 when the lower flap 44 is rotated to a position against the carton. Also referring to FIG. 5, a notch 50 may be cut out of the upper side flap 46 which facilitates folding of the upper side flap as the lower flap 44 is rotated to its closed position against the container. Preferably, the lower flap 44 is folded first, and then the upper flap 42 is rotated to its closed position in contact against the lower flap 44. An adhesive may be applied to the interior surface of the upper flap 42 in order to secure it against the lower flap 44.

A plurality of liquid or condensation slots 56 may be formed on the front panel 14 which allows any leaking beverage to drain through the slots 56. During shipment, the carton is preferably shipped so that the tops of the beverages are placed upside down thereby facilitating draining of fluid from a leaking beverage through the slots 56. Additionally, particularly in humid climates, condensation may form within the carton. Therefore, the slots 56 also allow condensation to flow out of the carton through the slots 56.

Figure 5:
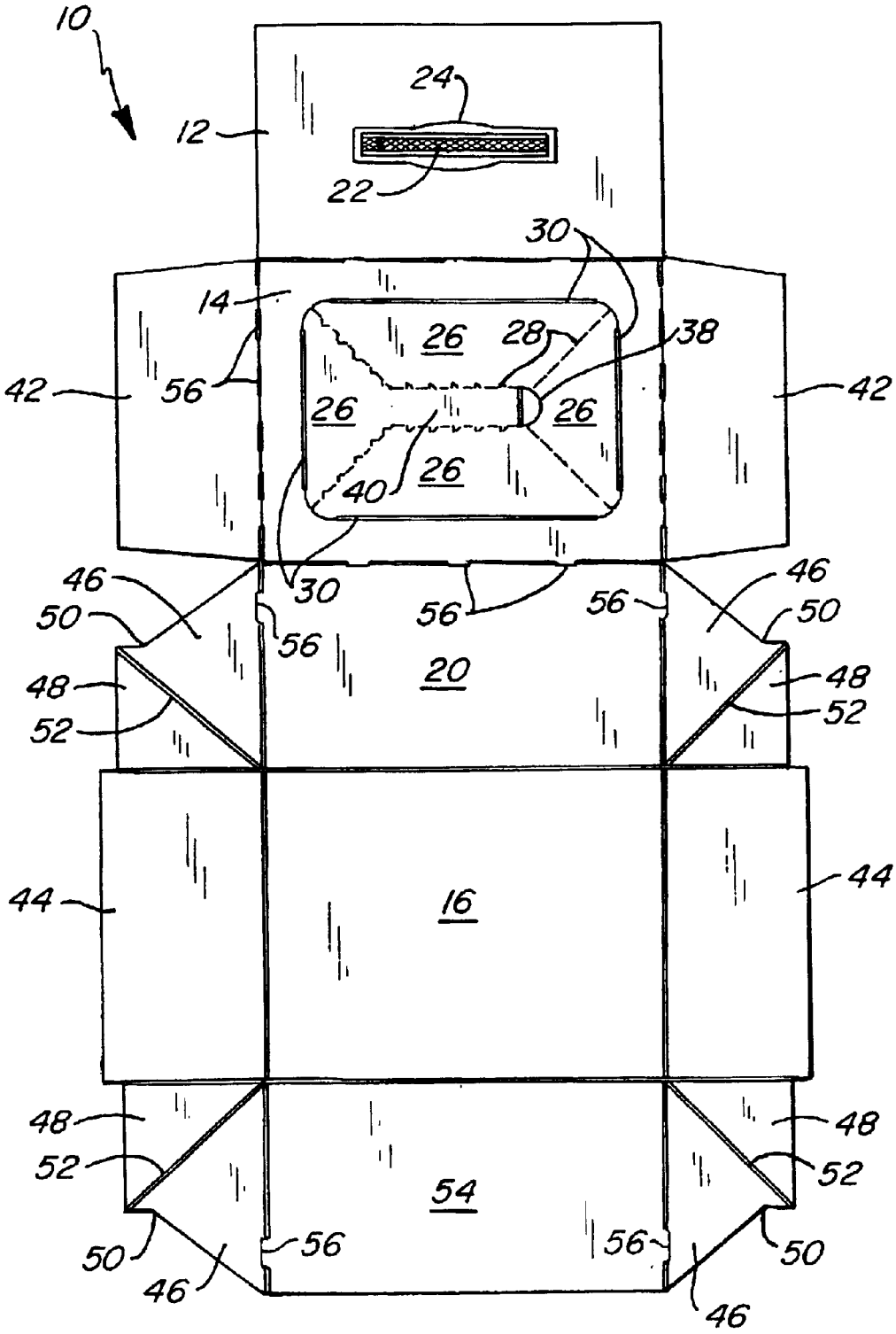
FIG. 5 is a plan view of the carton prior to assembly, illustrating the various fold lines and score lines, as well as other details of the invention.

Optionally, a liquid fill line 58 may be marked on the carton denoting the level at which liquid can be added to the carton without overflowing. This liquid fill line 58 may be placed on either the end panels or the upper and lower panels at some location below the upper edge of the lower flaps 44, as the upper edge of the lower flap 44 constitutes the highest level at which liquid can be added without overflowing the upper edge. The fill line could be printed on the inside as well as the outside of the carton as desired FIG. 5 illustrates the carton of this invention prior to being assembled. When assembled, the upper panel 12 is placed over an interior upper panel 54. An adhesive may be used to attach the interior upper panel 54 to the upper panel 12. Thus, the upper panel is of a double reinforced construction. Also, this double reinforced construction prevents leakage of liquid through the opening cut in the upper panel which exposes the handle 22. A plurality of additional slots 56 may also be formed on both the interior upper panel 54 and the lower panel 20 in order to further facilitate draining of leaking beverages and condensation, as well as to prevent overfilling of the carton above the fill line 58. Once the carton has been delivered to a retail location, the cartons are typically displayed so that the handle 22 is facing up allowing a consumer to more easily grasp the carton. Thus, the front panel 14 is no longer the most lower surface. If a beverage begins to leak while at the retail location, the slots 56 located on panel 20 will allow drainage. If the carton is stored in a refrigeration unit at the retail location, condensation is likely to develop because repeated opening and closing of the refrigeration unit by consumers introduces warm moist air into the carton which then condensates in the carton. Accordingly, the slots 56 on panel 20 facilitate draining of condensation. As also shown in FIG. 2, the slots 56 formed on panel 54 prevent overfilling of the carton because the slots are positioned above the fill line 58.

With the construction of the carton of the present invention, there is a continuous and unbroken group of panels which form a liquid containment area that may hold a quantity of liquid within the container. Cuts or perforations formed completely through the container along any of the folds encompassing the liquid containment area would compromise the integrity of the carton and the carton would therefore leak. With the present invention, the score lines encompassing the liquid containment area only penetrate the substrate thereby maintaining the integrity of the liquid impermeable layers.

If a fairly thick substrate is used, simply providing fold lines at some locations may make it too difficult to effectively fold the carton during assembly. Thus, score lines could be used which help to thin the substrate, thereby allowing the material to be more easily folded. Since the score lines only penetrate the substrate, the integrity of the polyethylene film or the extrudate is not compromised.

In addition to the carton described above, the invention herein also includes a method of assembling a beverage cooler carton including steps allowing the carton to receive cooling means within a liquid containment area. The method comprises the steps of providing a precut piece of material, providing various fold and/or score lines on the precut material, and folding the material into a final shape based upon the various fold/score lines, wherein the material includes continuous end flaps interconnecting the upper and lower panels, and which are folded to maintain continuity of the polyethylene film. The front panel includes various perforations allowing a user to break open the front panel along the perforations, thereby forming an access opening exposing the beverages. Without the lower side flaps, there would be no continuous piece or section of material which joined the lower flap of the end panels to the lower portions of the upper and lower panels. These lower side flaps provide a continuous seal, even across a score line which can be used for folding of the end flaps. Simply attaching the end panels to the upper and lower panels by a free-hanging flap attached to either the end panels or the front and rear panels would make it much more difficult to maintain the sealed nature of the liquid containment area. Adhesive or some other bonding agent alone would be inadequate to maintain a seal at the comers between the end panels and the upper and lower panels.

By the foregoing, it can be seen that the carton of this invention has many advantages. The carton may be made of a single piece of material which is cut into a desired shape, and includes various fold and score lines delineating the various folds and bends of the carton when assembled. The dual layer of liquid-impermeable components allows the carton to receive and hold ice or other cooling means. This dual layer is not compromised when the carton is assembled. Therefore, after assembly, no additional steps are necessary in maintaining the waterproof nature of the carton. The unique construction of the end panels provides not only strength, but also maintains the integrity of the liquid containment area. Access to the interior of the carton is achieved through the front or rear panel which provides the largest area to access the contents of the carton. Accordingly, ice or other cooling means may be more effectively spread across the carton for cooling. The perforations formed directly on the front or rear panel also provide a means for accessing the interior contents of the carton without having to provide any additional structure or material for accessing the carton. It shall be understood that the perforations for accessing the carton contents may be spaced groups of score lines which only penetrate the substrate, and do not otherwise compromise the outer polyethylene film or the extrudate. Therefore, the perforations do not substantially alter the strength of the front panel, yet allow easy and efficient access to the contents of the carton. The carton is of simple construction, yet effectively serves the dual purpose of providing packaging for beverages, and providing a package or carton which allows the beverages to be cooled directly within the carton.

This invention has been described with respect to a preferred embodiment; however, it will be understood that various modifications and changes can be made which are contemplated within the spirit and scope of this invention.

What is claimed is:

1. A carton for holding a plurality of products, said carton comprising:

a plurality of panels including opposing front and rear panels, an upper panel opposing a lower panel, and opposing end panels, said plurality of panels when assembled forming the carton enclosing an interior open space;

said end panels each including an upper flap attached to said front panel, and a lower flap attached to said rear panel;

a pair of foldable side flaps interconnecting said lower flap to said upper and lower panels;

said front panel being substantially planar and constructed of a continuously extending sheet of material, and a plurality of perforations formed thereon defining an access opening when said perforations are broken to expose said interior open space, said front panel remaining as a single unitary member prior to breaking of said perforations;

wherein said rear panel, said upper and lower panels, and said end panels form a continuous and unbroken liquid containment area for holding an amount of liquid therein; and said plurality of perforations define a plurality of access panels which are foldable away from said front panel and which communicate with said access opening, said plurality of access panels terminating at locations spaced interiorly from a periphery defining said front panel.

2. A carton, as claimed in claim 1, wherein:

said top panel includes a handle attached thereto.

3. A carton, as claimed in claim 1, wherein:

each said foldable side flap includes an upper side flap having an edge connected to an adjacent upper or lower panel, and a lower side flap having an edge connected to said lower flap.

4. A carton, as claimed in claim 3, wherein:

said foldable side flap includes a diagonal fold defining an interface between said upper side flap and said lower side flap, said diagonal fold allowing said upper and lower side flaps to be folded against one another when said lower flap is folded towards said carton.

5. A carton, as claimed in claim 4, wherein: each said upper side flap includes a notch formed thereon facilitating folding of said upper side flap against said lower side flap.

6. A carton, as claimed in claim 1, wherein:

said carton includes a liquid level line defining a recommended maximum fill line for liquid in said carton.

7. A carton, as claimed in claim 1, wherein:

said carton is made from a single sheet of pre-cut material.

8. A carton, as claimed in claim 1, wherein:

said carton is made of composite material including a substrate and a liquid impermeable film bonded to said substrate.

9. A carton, as claimed in claim 8, wherein:

said liquid impermeable film includes a polyethylene film.

10. A carton, as claimed in claim 8, wherein:

said liquid impermeable film is bonded to said substrate by a polyethylene extrudate.

11. A carton, as claimed in claim 1, further including:

a tab located between at least two opposing access panels of said plurality of access panels and connected to a third access panel of said plurality of access panels.

12. A carton, as claimed in claim 1, wherein:

said carton further includes a plurality of slots positioned on edges of said front panel and said opposing end panels to facilitate draining of leaking containers or condensation, or to prevent overfilling during use.

13. A carton for holding a plurality of products, said carton comprising:

a plurality of panels formed from a single sheet of material, said material being liquid impervious;

said plurality of panels including opposing front and rear panels, opposing upper and lower panels, and opposing end panels, said plurality of panels when assembled forming the carton enclosing an interior open space;

said rear panel, and lower portions of said upper, lower, and end panels defining a continuous and unbroken liquid containment area;

said front panel being substantially planar, and said front panel having a plurality of perforations formed thereon defining an access opening when said perforations are broken to expose said interior open space said end panels each including an upper flap remaining attached to said front panel, and a lower flap remaining attached to said rear panel: and said plurality of perforations defining a plurality of access panels which are foldable away from said front panel and which communicate with said access opening, said plurality of access panels extending from a center area of said front panel and terminating at locations spaced interiorly from a periphery defining said front panel.

14. A carton, as claimed in claim 13, wherein:

said material includes a liquid impermeable membrane applied thereto to make said material liquid impermeable.

15. A carton, as claimed in claim 13, wherein:

said carton further includes a plurality of slots positioned on edges of said front panel and said opposing end panels to facilitate draining of leaking containers or condensation, or to prevent overfilling during use.

* * * * *

UNITED STATES PATENT AND TRADEMARK OFFICE

CERTIFICATE OF CORRECTION

PATENT NO. : 6,945,450 B2
DATED : September 20, 2005
INVENTOR(S) : Rusnock

It is certified that error appears in the above-identified patent and that said Letters Patent is hereby corrected as shown below:

Column 7,
Line 50, add -- each -- before "said".

Column 8,
Line 42, after "panel" delete ":" and insert -- ; --.

Signed and Sealed this

Seventh Day of February, 2006

JON W. DUDAS
*Director of the United States Patent and Trademark Office*